United States Patent [19]

Walter et al.

[11] Patent Number: 4,875,026

[45] **Date of Patent: * Oct. 17, 1989**

[54] DIELECTRIC WAVEGUIDE HAVING HIGHER ORDER MODE SUPPRESSION

[75] Inventors: Jeffrey A. Walter, Wilmington; Kailash C. Garg, Newark; Joseph C. Rowan, Wilmington, all of Del.

[73] Assignee: W. L. Gore & Associates, Inc., Newark, Del.

[ * ] Notice: The portion of the term of this patent subsequent to Nov. 15, 2005 has been disclaimed.

[21] Appl. No.: 86,403

[22] Filed: Aug. 17, 1987

[51] Int. Cl.[4] ..... H01P 1/162

[52] U.S. Cl. ..... 333/251; 333/239

[58] Field of Search ..... 333/251, 242, 239; 174/110 FC

[56] References Cited

U.S. PATENT DOCUMENTS

| | | | |
|---|---|---|---|
| 2,915,715 | 12/1959 | Young, Jr. | 333/251 X |
| 3,601,720 | 8/1971 | Nakahara et al. | 333/251 |
| 3,703,690 | 11/1972 | Ravenscroft et al. | 333/251 X |
| 4,319,940 | 3/1982 | Arroyo et al. | 174/110 FC |
| 4,441,091 | 4/1984 | Nishida et al. | 333/242 |
| 4,525,693 | 6/1985 | Suzuki et al. | 333/242 X |
| 4,701,576 | 10/1987 | Wada et al. | 174/110 FC |
| 4,785,268 | 11/1988 | Walter et al. | 333/157 |

FOREIGN PATENT DOCUMENTS

| | | | |
|---|---|---|---|
| 1473655 | 5/1977 | United Kingdom | 333/242 |

*Primary Examiner*—Eugene R. LaRoche
*Assistant Examiner*—Benny T. Lee
*Attorney, Agent, or Firm*—Mortenson & Uebler

[57] ABSTRACT

A dielectric waveguide for the transmission of electromagnetic waves is provided comprising a core of polytetrafluoroethylene (PTFE), one or more layers of PTFE cladding overwrapped around the core, a mode suppression layer of an electromagnetically lossy material covering the cladding and an electromagnetic shielding layer covering the mode suppression layer. The mode suppression layer is preferably a tape of carbon-filled PTFE. Another electromagnetically lossy material layer may be placed around the shield to absorb any extraneous energy.

13 Claims, 1 Drawing Sheet

DIELECTRIC WAVEGUIDE HAVING HIGHER ORDER MODE SUPPRESSION

BACKGROUND OF THE INVENTION

This invention relates to a dielectric waveguide for the transmission of electromagnetic waves. More particularly, the invention relates to a dielectric waveguide having means for higher order mode suppression.

Electromagnetic fields are characterized by the presence of an electric field vector E orthogonal to a magnetic field vector H. The oscillation of these components produces a resultant wave which travels in free space at the velocity of light and is transverse to both. The power magnitude and direction of this wave is obtained from the Poynting vector given by:

$$P=E\times H \text{ (Watts/m}^2\text{)}$$

Electromagnetic waves may exist in both unbounded media (free space) and bounded media (coaxial cable, waveguide, etc.). This invention relates to the behavior of electromagnetic energy in a bounded medium and, in particular, in a dielectric waveguide.

For propagation of electromagnetic energy to take place in a bounded medium, it is necessary that Maxwell's Equations are satisfied when the appropriate boundary conditions are employed.

In a conventional metal waveguide these conditions are that the tangential component of the electric field, $E_t$, is zero at the metal boundary and also that the normal component of the magnetic flux density, $B_n$, is zero.

The behavior of such a waveguide structure is well understood. Under excitation from external frequency sources, characteristic field distributions or modes will be set-up. These modes can be controlled by variation of frequency, waveguide shape and/or size. For regular shapes, such as rectangles, squares or circles, the well-defined boundary conditions mean that operation over a specific frequency band using a specific mode is guaranteed. This is the case with most rectangular waveguide systems operating in a pure $TE_{10}$ mode. This is known as the dominant mode in that it is the first mode to be encountered as the frequency is increased. The $TE_{mm}$ type nomenclature designates the number of half sinusoidal field variations along the x and y axes, respectively.

Another family of modes in standard rectangular waveguides are the $TM_{mm}$ modes, which are treated in the same way. They are differentiated by the fact that $TE_{mm}$ modes have no $E_z$ component, while $TM_{mm}$ modes have no $H_z$ component.

The dielectric waveguide disclosed in U.S. Pat. No. 4,463,329 does not have such well-defined boundary conditions. In such a dielectric waveguide, fields will exist in the polytetrafluoroethylene (PTFE) cladding medium. Their magnitude will decay exponentially as a function of distance away from the core medium. This phenomena also means that, unlike conventional waveguides, numerous modes may, to some degree, be supported in the waveguide depending upon the difference in dielectric constant between the mediums, the frequency of operation and the physical dimensions involved. The presence of these so-called "higher order" modes is undesirable in that they extract energy away from the dominant mode, causing excess loss. They cause, in certain cases, severe amplitude ripple and they contribute to poor phase stability under conditions of flexure.

A launching horn employed in conjunction with a waveguide taper performs a complex impedance transformation from conventional waveguide to the dielectric waveguide. Techniques such as the finite element method may be used to make this transformation as efficient as possible. However, the presence of any impedance discontinuity will result in the excitation of higher other modes.

Having described the ways in which higher order modes may be stimulated in such a dielectric waveguide assembly, means for suppressing their presence will now be disclosed.

SUMMARY OF THE INVENTION

A dielectric waveguide for the transmission of electromagnetic waves is provided comprising a core of PTFE, one or more layers of PTFE cladding overwrapped around the core, and a mode of suppression layer of an electromagnetically lossy material covering the cladding. The mode suppression layer is preferably a tape of carbon-filled PTFE. The core may be extruded, unsintered PTFE; extruded, sintered PTFE; expanded, unsintered, porous PTFE; or expanded, sintered, porous PTFE. The core may contain a filler. The cladding layer(s) may be extruded, unsintered PTFE; extruded, sintered PTFE; expanded, unsintered, porous PTFE; or expanded, sintered, porous PTFE. The cladding layer(s) may contain a filler. The dielectric waveguide may have an electromagnetic shielding layer covering the mode suppression layer which, preferably, is aluminized Kapton® polyimide tape. The dielectric waveguide may be further overwrapped with a tape of carbon-filled PTFE.

DETAILED DESCRIPTION OF THE INVENTION AND PREFERRED EMBODIMENTS WITH REFERENCE TO THE DRAWINGS

A dielectric waveguide for the transmission of electromagnetic waves is provided comprising a core of polytetrafluoroethylene (PTFE), one or more layers of PTFE cladding overwrapped around the core, a mode suppression layer of an electromagnetically lossy material covering the cladding and an electromagnetic shielding layer covering the mode suppression layer. The mode suppression layer is preferably a tape of carbon-filled PTFE. Another electromagnetically lossy material layer may be placed around the shield to absorb any extraneous energy.

This invention is based on the premise that, unlike the required guided mode in a dielectric waveguide, the higher order modes exist to a far greater extent in the cladding. This being the case, a mode suppression layer is placed around the cladding to absorb the unwanted modes as they impinge on the cladding/free space interface. In so doing, care must be taken not to truncate the electric field distribution of the required guided mode, as it too decays exponentially into the cladding. This is controlled by the amount of cladding used. The so-called mode suppression layer may be of carbon-filled PTFE. A shielding layer may be placed around the mode suppression layer and another electromagnetically lossy material layer may be placed around the shield to absorb any extraneous energy.

Figure 1:
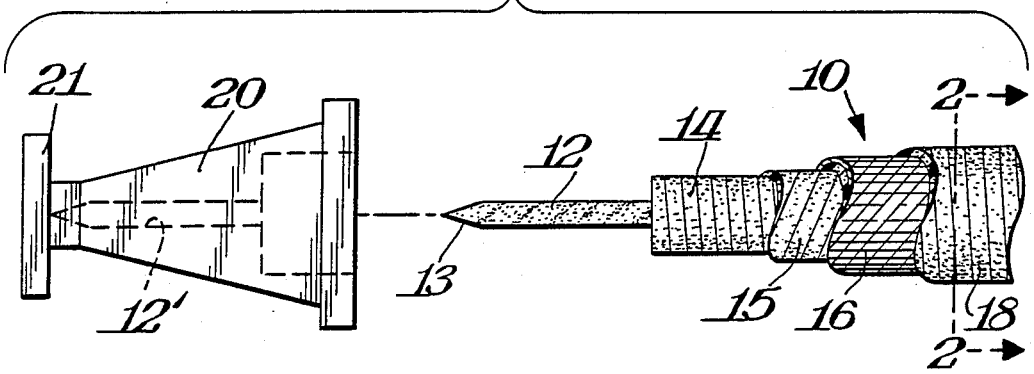
FIG. 1 is a side elevation, with parts of the dielectric waveguide cut away for illustration purposes, of the dielectric waveguide according to the invention and showing one launcher.

A detailed description of the invention and preferred embodiments is best provided with reference to the accompanying drawings. FIG. 1 shows the dielectric waveguide of the invention, with parts of the dielectric waveguide cut away for illustration purposes. When launcher 20 with conventional flange 21 is connected to dielectric waveguide 10, within seat 12' indicated by the dashed lines, electromagnetic energy enters the launcher 20. An impedance transformation is carried out in the taper 13 of the core 12 of waveguide 10 such that the energy is coupled efficiently into the core 12 of dielectric waveguide 10. Once captured by the core 12, propagation takes place through the core 12 which is surrounded by cladding 14. The core 12 is polytetrafluoroethylene and the cladding 14 is polytetrafluoroethylene, preferably expanded, porous polytetrafluoroethylene tape wrapped over core 12. Propagation occurs as a result of refraction at the core/cladding interface. This refraction occurs as a consequence of applying Snell's law at this boundary interface where appropriate choice of the core and cladding dielectric constants aid containment of the energy within the guiding core. The core and/or cladding may contain any recognized high dielectric constant, low loss tangent filler material such as barium titanate, barium tetra-titanate, titanium dioxide or silicon dioxide. Mode suppression layer 15 covers the cladding 14. Layer 15 is a layer of an electromagnetically lossy material. Preferably, the mode suppression layer 15 is carbon-filled PTFE tape wrapped about the cladding 14.

To prevent cross-coupling or interference from external sources, an electromagnetic shield 16 is provided as well as an external absorber 18. The shield is preferably aluminized Kapton ® polyimide tape, and the absorber is preferably carbon-filled PTFE tape.

Figure 2:
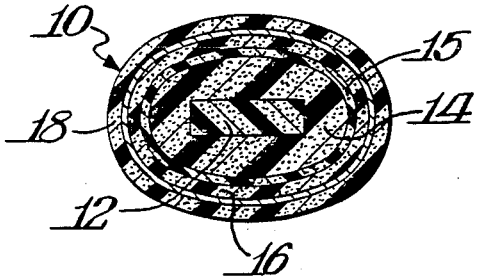
FIG. 2 is a cross-sectional view of the dielectric waveguide of the invention taken along the line 2—2 of FIG. 1.

FIG. 2 is a cross-sectional view of dielectric waveguide 10 taken along line 2—2 of FIG. 1 showing rectangular core 12 overwrapped with tape 14 covered by mode suppression layer 15 and showing shield layer 16 and absorber layer 18.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A dielectric waveguide for the transmission of electromagnetic waves having a dominant mode and higher order modes, said dielectric waveguide comprising:

(a) a core of PTFE;

(b) at least one layer of PTFE cladding wrapped around said core;

(c) a higher order mode suppression layer of an electromagnetically lossy material covering said cladding, said higher order mode suppression layer providing suppression of modes other than the dominant mode;

(d) an electromagnetic shielding layer covering said mode suppression layer; and (e) a carbon-filled PTFE tape covering said electromagnetic shielding layer.

2. The dielectric waveguide of claim 1 wherein said mode suppression layer is a tape of carbon-filled PTFE.

3. The dielectric waveguide of claim 1 wherein said core is extruded, unsintered PTFE.

4. The dielectric waveguide of claim 1 wherein said core is extruded, sintered PTFE.

5. The dielectric waveguide of claim 1 wherein said core is expanded, unsintered, porous PTFE.

6. The dielectric waveguide of claim 1 wherein said core is expanded, sintered, porous PTFE.

7. The dielectric waveguide of claim 1 wherein said core contains a filler selected from the class consisting of barium titanate, barium tetra-titanate, titanium dioxide and silicon dioxide.

8. The dielectric waveguide of claim 1 wherein said cladding layer(s) is extruded, unsintered PTFE.

9. The dielectric waeguide of claim 1 wherein said cladding layer(s) is extruded, sintered PTFE.

10. The dielectric waveguide of claim 1 wherein said cladding layer(s) is expanded, unsintered, porous PTFE.

11. The dielectric waveguide of claim 1 wherein said cladding layer(s) is expanded, sintered, porous PTFE.

12. The dielectric waveguide of claim 1 wherein said cladding layer(s) contains a filler selected from the class consisting of barium titanate, barium tetra-titanate, titanium dioxide and silicon dioxide.

13. The dielectric waveguide of claim 1 wherein said shielding layer is aluminized Kapton ® polyimide tape.

* * * * *

UNITED STATES PATENT AND TRADEMARK OFFICE

CERTIFICATE OF CORRECTION

PATENT NO. : 4,875,026

DATED : October 17, 1989

INVENTOR(S) : Jeffrey A. Walter; Kailash C. Garg; Joseph C. Rowan

It is certified that error appears in the above-identified patent and that said Letters Patent is hereby corrected as shown below:

In the Specification:

In col. 1, line 45, please change "$TE_{mm}$" to --$TE_{mn}$--.

In col. 1, line 50, please change "$TM_{mm}$" to --$TM_{mn}$--.

In col. 1, line 52, please change "$TE_{mm}$" to --$TE_{mn}$--.

In col. 1, line 52, please change "$TM_{mm}$" to --$TM_{mn}$--.

In col. 2, line 10, please change "other" to --order--.

In col. 2, line 20, please delete "of" after "mode" and before "suppression".

In the Claims:

In col. 4, line 38, claim 9, please change "waeguide" to --waveguide--.

Signed and Sealed this

Eleventh Day of September, 1990

*Attest:*

HARRY F. MANBECK, JR.

*Attesting Officer*

*Commissioner of Patents and Trademarks*